US008515571B1

(12) United States Patent
Bagley

(10) Patent No.: US 8,515,571 B1
(45) Date of Patent: Aug. 20, 2013

(54) METHOD AND APPARATUS FOR AUTOMATED SEGMENTAL SEWING OF OVER-SIZED SEWING PATTERN

(75) Inventor: Jim Matthews Bagley, West Valley City, UT (US)

(73) Assignee: Gracewood Management, Inc., West Valley City, UT (US)

( * ) Notice: Subject to any disclaimer, the term of this patent is extended or adjusted under 35 U.S.C. 154(b) by 41 days.

(21) Appl. No.: 13/410,291

(22) Filed: Mar. 2, 2012

(51) Int. Cl.
*D05B 19/08* (2006.01)

(52) U.S. Cl.
USPC ..... 700/136

(58) Field of Classification Search
USPC .... 700/136, 137, 138, 135, 134; 112/470.01, 112/470.04, 470.06, 470.07, 470.09, 117, 112/118
See application file for complete search history.

(56) References Cited

U.S. PATENT DOCUMENTS

| | | | | |
|---|---|---|---|---|
| 4,953,485 | A | 9/1990 | Brower et al. | |
| 5,095,835 | A | 3/1992 | Jernigan et al. | |
| 5,537,946 | A | 7/1996 | Sadeh et al. | |
| 5,544,599 | A | 8/1996 | Frazer et al. | |
| 5,865,133 | A * | 2/1999 | Herbach et al. | 112/475.19 |
| 6,026,756 | A * | 2/2000 | Frazer et al. | 112/118 |
| 6,158,366 | A * | 12/2000 | Codos | 112/117 |
| 6,216,619 | B1 | 4/2001 | Musco et al. | |
| 6,237,516 | B1 * | 5/2001 | Wakayama | 700/138 |
| 6,237,517 | B1 | 5/2001 | Bondanza et al. | |
| 6,263,816 | B1 * | 7/2001 | Codos et al. | 112/475.08 |
| 6,367,397 | B1 | 4/2002 | Musco et al. | |
| 6,755,141 | B2 | 6/2004 | Musco et al. | |
| 6,796,254 | B2 | 9/2004 | Bondanza et al. | |
| 7,063,028 | B2 * | 6/2006 | Codos et al. | 112/2.1 |
| 7,210,419 | B2 * | 5/2007 | Naka et al | 700/136 |
| 7,840,304 | B2 * | 11/2010 | Mizuno | 700/138 |
| 7,954,441 | B2 * | 6/2011 | Stutznacker et al. | 112/475.05 |
| 8,074,590 | B2 | 12/2011 | Bentley | |
| 8,087,368 | B2 | 1/2012 | Raimondo | |
| 2009/0151612 | A1 | 6/2009 | Bentley | |
| 2011/0005441 | A1 | 1/2011 | Roche | |
| 2011/0190922 | A1 | 8/2011 | Walker et al. | |

* cited by examiner

*Primary Examiner* — Danny Worrell
(74) *Attorney, Agent, or Firm* — J. David Nelson

(57) ABSTRACT

A method and apparatus for automated assisted sewing of an oversized, digitized sewing pattern, using a fabric retention mechanism and an automated sewing machine positioning mechanism. The sewing machine positioning mechanism is controlled by an actuator and provides for two dimensional positioning of a sewing machine with respect to the fabric retention mechanism. The oversized sewing pattern is segmented into pattern segments and the pattern segments are sewed sequentially in accordance with a selected order, with the fabric being repositioned after each segment is sewed. Cut points for pattern lines on the border of each pattern segment are matched by start points on the adjacent border of a subsequently sewed, adjacent pattern segment. A pattern program adjusts the pattern lines of each subsequently sewed segment to provide for continuity and alignment of the pattern lines which cross the borders between pattern segments.

10 Claims, 8 Drawing Sheets

METHOD AND APPARATUS FOR AUTOMATED SEGMENTAL SEWING OF OVER-SIZED SEWING PATTERN

FIELD OF THE INVENTION

The present invention is in the field of methods and apparatuses for automated quilting, in particular in the field of methods and apparatuses for the automated control of mechanized quilting frame providing for movement of a sewing machine mounted thereon.

BACKGROUND OF THE INVENTION

Automated quilting has become increasingly popular because it allows persons to quilt who lack the time, skill, physical ability or patience to quilt by hand. Mechanized quilting frames provide for a sewing machine to be mounted on a sewing machine carriage which is movably mounted on the quilting frame. The sewing machine carriage typically has a pair of carriage motors, each motor being connected to a gear box which is connected to a carriage drive mechanism. The carriage drive mechanism interacts with the quilting frame, thereby providing for the two dimensional, x-y, horizontal movement of the sewing machine carriage and the sewing machine mounted thereon. This x-y horizontal movement of the sewing machine provides for the automated positioning of the sewing machine for the automated sewing of a pattern. The fabric layers being quilted are typically held on and between a pair of fabric rails, a feed rail and a take up rail, the take up rail passing through the throat of the sewing machine and the feed rail being positioned outside the throat of the sewing machine. The two fabric rails provide for the linear positioning and retention of the fabric and for maintaining a desired tension on the fabric as the sewing machine is moved in the x and y dimensions and sews a desired pattern.

A typical prior art automated quilting frame 4 is illustrated in FIG. 1. A sewing machine 1 mounted on a sewing machine carriage 2 and engaged in an automated sewing operation on a typical prior art quilting frame 4 is illustrated. The feed rail 3 and the take up rail 5 hold all the layers of fabric 7, alternatively referred to in this application as the "fabric", in position as the sewing operation is under way. It will be noted on FIG. 1, that the y dimension movement 9 of the sewing machine in the y dimension 11 is limited by the machine throat length 13, which is the distance between the outside throat surface 15 and the inside throat surface 17. The throat length 13 is obviously structurally related to the arm length 19 of the sewing machine arm 21.

In FIG. 1, the sewing machine 1 is shown in maximum forward position 23. Referring also to FIG. 2, the sewing machine 1 is shown in its maximum rearward position 25. The maximum y dimension machine movement 27 is limited by the throat length 13. While the length of the mechanized quilting frame typically will accommodate the full width of the quilt and thereby allow for the x dimension movement of the sewing machine 1 in the x axis for the full width of the quilt, the throat length of a sewing machine obviously cannot be practically or economically increased to a dimension that would allow for the full length of the quilt to be deployed in the throat of the sewing machine.

The foregoing identifies a primary difficulty and limitation of known automated quilting systems. There have been a number of prior art methods and devices developed for attempting to deal with this difficulty and limitation, including, for example, devices providing for the automated scrolling of the fabric between a feed rail and a take up rail to provide for expanding the available effective y dimension movement. Some of the notable problems with such devices are fabric stretch and varying diameters of fabric roll on the feed rail and take up rail. Other prior art methods and devices are known which provide for dividing oversized embroidery patterns and for the segmented sewing of the patterns. A notable problem with such methods and devices is that they do not provide for the pattern adjustment that is required in consecutively sewed pattern segments to provide for an accurate match of pattern lines between segments and to provide for the preservation of the integrity of the overall pattern as sewed.

It is therefore an objective of the present invention to provide a method and apparatus for the automated sewing of an over-sized quilt pattern, or other sewing pattern such as an embroidery pattern, i.e., a sewing pattern that has a length that is greater than the available throat length of the sewing machine being used, or has a width that is greater than the maximum available lateral movement of the sewing machine.

It is a further objective of the present invention to provide a method and apparatus for the automated sewing of an over-sized quilt pattern or other sewing pattern that provides for the accurate sewing of complex, over-sized, sewing patterns.

It is a further objective of the present invention to provide a method and apparatus for automated sewing of over-sized sewing patterns that minimizes stitching error or mismatch.

It is a further objective of the present invention to provide a method and apparatus for automated sewing of an over-sized sewing pattern that operates with fabric positioned stationary on a feed rail or other feed mechanism and a take-up rail or other take-up mechanism during the sewing operation.

It is a further objective of the present invention to provide a method and apparatus for automated sewing of an over-sized sewing pattern by dividing the sewing pattern into pattern segments and providing for matching the stitching at the respective borders of the segments of the pattern, thereby preventing stitching mismatch at segmental borders.

It is a further objective of the present invention to provide a method and apparatus for automated sewing of an over-sized sewing pattern which provide for dividing the sewing pattern into pattern segments and provide for accurately matching of the stitching at the respective borders of the segments of the pattern, while preserving the integrity of the overall pattern, by adjusting the pattern lines in consecutively sewed pattern segments.

SUMMARY OF THE INVENTION

As stated previously, a primary difficulty and limitation with automated quilting or automated sewing of other items arises from the limitation imposed on y dimension movement of the sewing machine carriage and thus the sewing machine. So long as the pattern width is less than the quilt or other sewing item width and the mechanized quilting or sewing frame accommodates the full width of the quilt or other sewing item, then the x dimension movement is not a problem for a typical automated quilting or sewing frame. The difficulty arises when the pattern length is greater than the maximum y dimension needle bar travel, which is limited by the available throat length of the sewing machine. The available throat length is dependent on the throat length, the amount of fabric on the take-up rail, and the diameter of the fabric roll.

The sewing pattern selected by the user may be obtained by the user from a number of sources. Electronic data bases containing multiple patterns that a user may select from for automated quilting frame are readily available. Systems are also known that allow the user to generate a digital pattern using a computer aided drafting program.

The method and apparatus of the present invention provides for segmenting of the sewing pattern to pattern segments, with the segment length of each of the pattern segments being less than or equal to maximum y dimension needle bar travel. Simplified embodiments of the method and apparatus of the present invention require the user to select the pattern segment borders between the respective pattern segments. However, preferred embodiments of the method and apparatus of the present invention will provide for the automated selection of segment borders by an actuator, or may provide for the user to have the option of manually selecting one or more of the segment borders and having the actuator select one or more of the segment borders.

For some preferred embodiments, the actuator may have a pattern program with a segmentation algorithm which will attempt to optimize the segment border selection. The segmentation algorithm may rely on variables such as the number of pattern lines that will be cut by the segment border and the position of the cut points, to optimize the segment border selection. Other embodiments of the pattern program may provide simply for the division of the pattern into the pattern segments of equal length. Generally, however, preferred embodiments of the pattern program may attempt to optimize the segment borders by minimizing the number of cut points.

A preferred embodiment of the apparatus of the present invention may include an actuator with a pattern program that will display the selected pattern and display the segment borders. The user may have previously input the maximum y dimension needle bar travel, which is the maximum y dimension movement of the sewing machine carriage, and which may be equal to or dependent on the available throat length. Preferred embodiments may initially divide the pattern into pattern segments of equal segment length. Other preferred embodiments may provide for the pattern program to initially attempt to optimize the location of the segment borders, with the user confirming or modifying the segment borders.

Once the segment borders have been selected, the user may proceed to the sewing of the pattern. The user may select to sew the pattern segments in any order, but a preferred method would be to start with the top pattern segment and work down or to start with the bottom pattern segment and work up.

For a typical quilting frame application of the present invention, once the fabric is in position on a feed rail or other feed mechanism, and the fabric is fed into the throat of the sewing machine and rolled onto the take-up rail or other take-up mechanism, the fabric is fed onto and rolled onto the take up rail in sufficient quantity to appropriately position the fabric for sewing the pattern segment selected for sewing. The pattern program is then actuated and the selected pattern segment stitching is sewn into the fabric. Additional fabric is then rolled onto to the take up rail, positioning the fabric for the stitching of the next pattern segment.

Cut points are identified along the border between the previously sewed pattern segment and the next pattern segment to be sewed, which are points where the pattern lines of the previously sewed segment intersect the border between the two pattern segments. Once the fabric has been advanced, thereby positioning the second pattern segment for stitching, the user may manually move the needle sequentially to the each of the cut points. When positioning the needle immediately over the cut points, the user confirms, at an actuator, for the pattern program, that the needle is at the cut point position.

The pattern lines for the second pattern segment are then adjusted by the pattern program to match start points for the pattern lines of the second pattern segment to the cut points of the first pattern segment. The overall pattern for the second pattern segment is then adjusted to preserve the proportionality, overall presentation, and appearance of the second pattern segment. The stitching of the second pattern segment then begins at the adjusted start points which match the cut points of the previously sewed pattern segment as opposed to the pattern program attempting to maintain the design dimensions and design orientation of the pattern. Not only may the distance between start points be changed from the original pattern, due to the characteristics of the fabric and advancing the fabric, the angular orientation may also be altered. Therefore it is essential that the stitching of the second pattern segment start at the actual cut point location as opposed to a theoretical cut point location.

Once the matching of the cut points of the first pattern segment with the start points of the second pattern segment is accomplished, and the overall adjustment of the pattern lines of the second segment is accomplished, the pattern program is actuated for sewing of the pattern for the second segment. The order of sewing of the lines of the second pattern segment can either be manually selected by the user under certain embodiments or the order of stitching the pattern lines of segment two may be determined by the pattern program. Once the second pattern segment has been stitched, the fabric is once again advanced to a position appropriate for the stitching of the third pattern segment. The process is repeated for each pattern segment, matching start points of each pattern segment to be sewed, to the cut points of previously sewed, adjacent pattern segments, and making appropriate corresponding adjustments in the pattern lines for the pattern segment to be sewed.

Preferred embodiments of the method of the present invention may also provide for the user, upon completion of the sewing of a pattern segment and the advancement of the fabric for the next pattern segment, to rely on the pattern program to move the sewing machine needle to the theoretically correct physical location of the cut point where the sewing should start. The pattern program captures the difference between where the needle might be theoretically positioned and the actual position of the cut point.

The pattern program then determines the appropriate adjustment in the stitching of the next segment to maintain the overall integrity of the stitched pattern. The ability of the pattern program to adjust the stitching of the pattern segments to match the cut points and the start points is an essential feature of the method and apparatus of the present invention. A start point alignment algorithm of the pattern program actually performs a pattern distortion so that the start points of the subsequent pattern segment will precisely match the cut points of the pattern lines of the previously stitched pattern segment. This is accomplished by the algorithm stretching or shrinking the pattern longitudinally or laterally, or both, to get the cut points and the start points to match between contiguous pattern segments.

Regardless of the number of pattern segments, the end result will be a finished pattern where all of the pattern stitching, for pattern lines which transition from one pattern segment to another, are continuous and appropriately aligned. While the adjustments made by the pattern program algorithms may result in a stitched pattern which varies dimensionally from the pattern selected by the user, the overall intent of the pattern and the presentation of the pattern will be preserved. The method may involve starting with any of the segments and progressing to the other segments in any order.

Additional, more complex variations of the method and apparatus of the present invention provide for accommodating a pattern having a pattern width that exceeds the maximum x dimension movement, also referred to as the maximum lateral movement, of the sewing machine with respect to a quilting frame or other fabric retention mechanism. For those embodiments, the pattern may be segmented laterally, in the x dimension, as well as longitudinally in the y dimension. For these variations of the present invention, the pattern segments have to be matched laterally as well as longitudinally. The method for segmenting and sewing a sewing pattern that is oversized laterally as well as longitudinally is similar to the method described above for segmenting and sewing patterns that are oversized only longitudinally.

Even if the pattern width of the sewing pattern does not exceed the maximum lateral movement of the sewing machine with respect to a quilting frame or other fabric retention mechanism, it may be desirable to segment the pattern laterally in order to reduce error and distortion of the pattern and to provide for better matching between longitudinal pattern segments. The result may be an overall more accurately sewed pattern.

First, the sewing pattern must be segmented both longitudinally and laterally. An order for sewing the segments is selected and the segments are processed and sewed sequentially in the order selected. As each segment is positioned for sewing, cut points for the pattern lines are located at the adjacent border for each previously sewed, longitudinally adjacent pattern segment, and start points are identified for the pattern segment to be sewed. Likewise, lateral cut points are located at the adjacent border for each previously sewed, laterally adjacent pattern segment, and lateral start points are identified for the pattern segment to be sewed. The pattern lines for the pattern segment to be sewed are then adjusted by the pattern program to fit the start points and the lateral start points.

The method and apparatus of the present invention may utilize any fabric retention mechanism and any sewing machine positioning system, so long as: (a) the fabric can be securely positioned and repositioned as the user progresses from pattern segment to pattern segment; (b) the user can position the needle bar at all cut points and all lateral cut points, respectively, of previously sewed adjacent pattern segments, and thereby generate digitized start points for the pattern segment to be sewed which will match the start points and lateral start points to the cut points and lateral cut points, respectively, of the previously sewed, adjacent pattern segments; and (c) the actuator can move the sewing machine, or the fabric retention mechanism, to follow the pattern within the pattern segment, as adjusted to provide for matching of the start points to the cut points of longitudinally adjacent pattern segments, and the lateral start points to the lateral cut points of laterally adjacent pattern segments.

The present invention is adapted for sewing a quilt pattern on multiple layers of fabric or for sewing a pattern on any fabric, multiple layers or single layers. For example, in addition to quilting, it can be used for embroidery involving only one layer of fabric. Even further, a fabric cutting device may be attached to a sewing machine needle bar and the sewing machine thereby used for cutting fabric, employing the method and apparatus of the present invention.

DETAILED DESCRIPTION OF PREFERRED EMBODIMENTS

Figure 1:
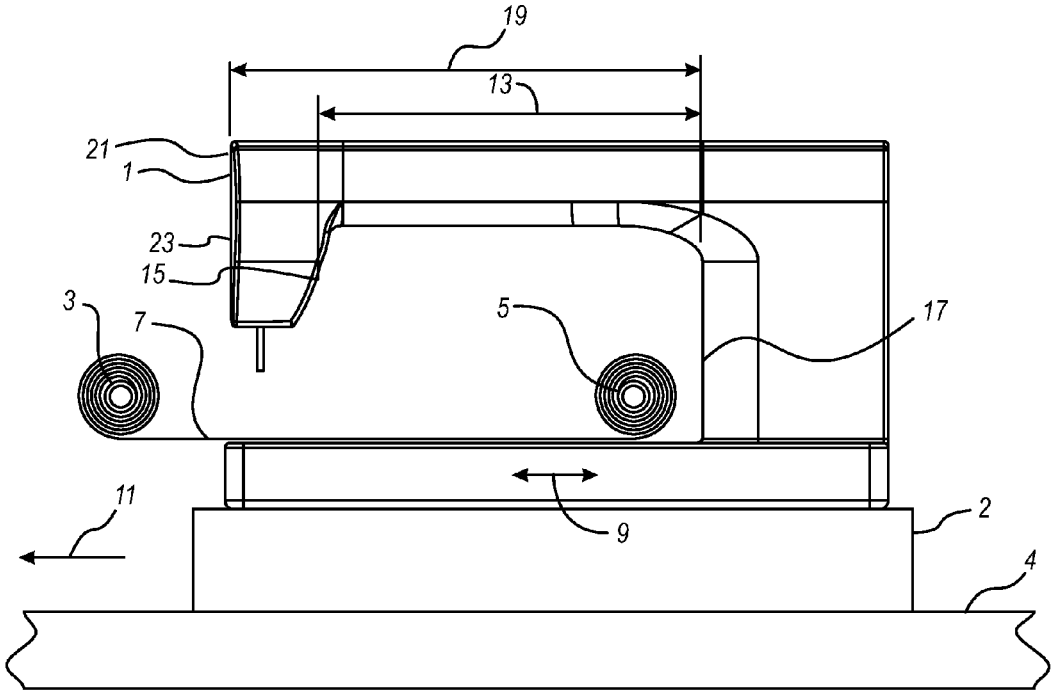
FIG. 1 is a side view, cross-section illustration of a typical prior art sewing machine mounted on a sewing machine carriage of an automated quilting frame, with the sewing machine in the maximum forward position.
Figure 2:
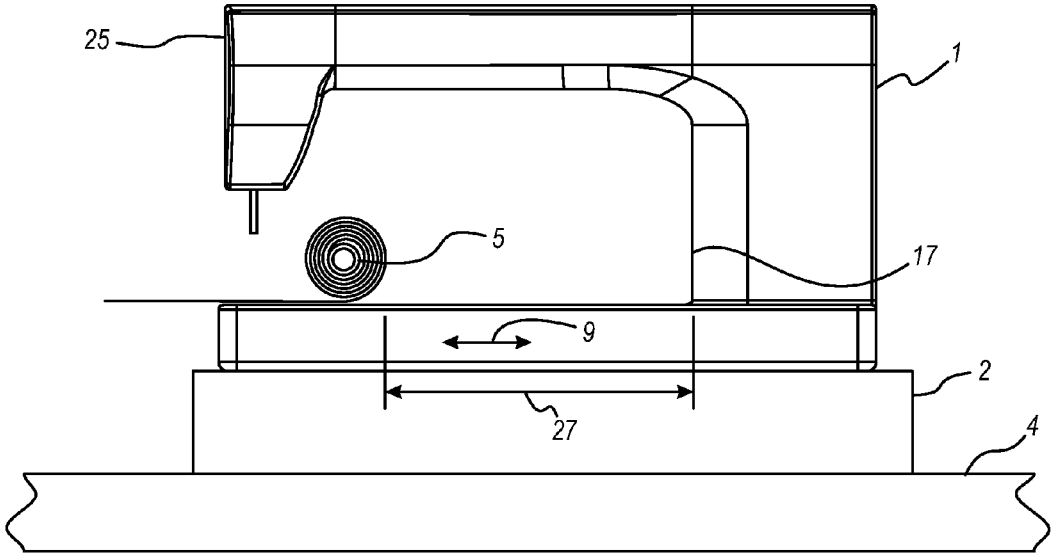
FIG. 2 is a side view, cross-section illustration of a typical prior art sewing machine mounted on a sewing machine carriage of an automated quilting frame, with the sewing machine in the maximum rearward position.
Figure 3:
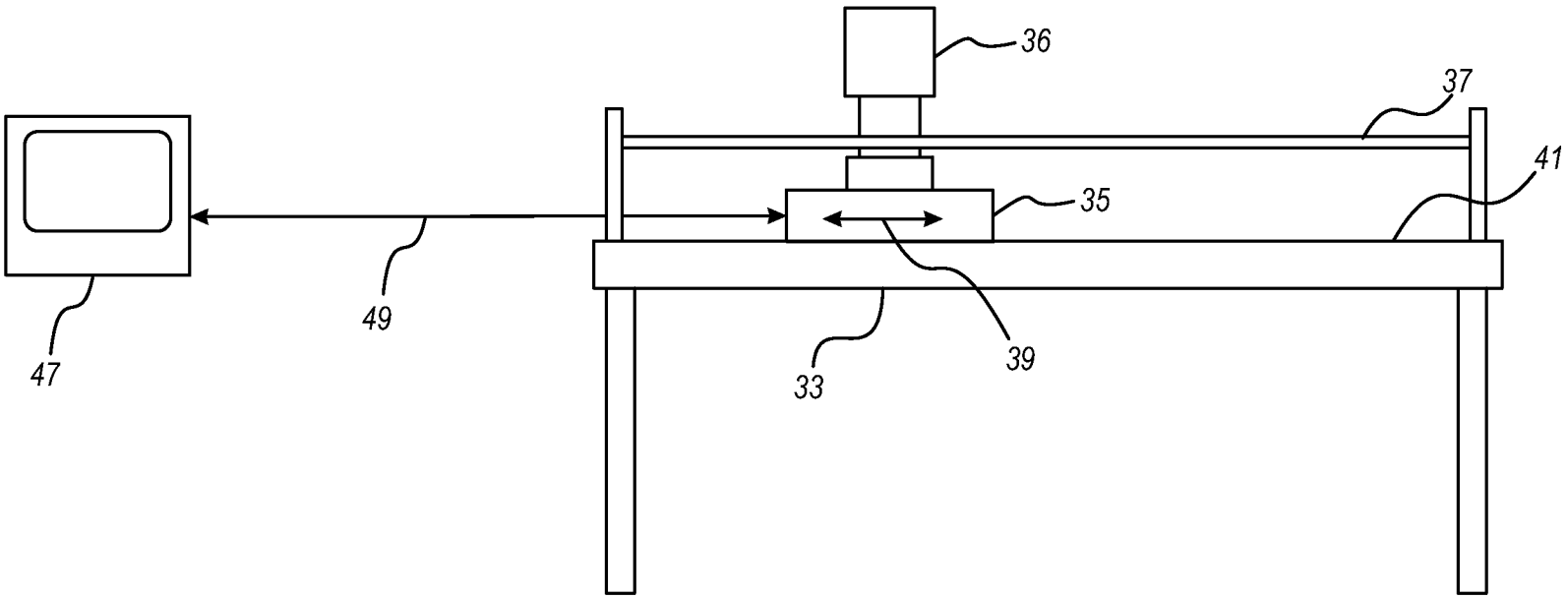
FIG. 3 is a front elevation illustration of a mechanized quilting frame employing a preferred embodiment of the method and apparatus of the present invention.

Referring first to FIG. 3, a front elevation illustration of a mechanized quilting frame 33 employing a preferred embodiment of the method and apparatus of the present invention, having a sewing machine carriage 35 with a sewing machine 36 mounted on the sewing machine carriage 35. Also shown is a feed rail 37 which is shown without a fabric roll that would be present on the feed rail 37 during a normal sewing operation. Typically, the sewing machine carriage has an x dimension motor and drive mechanism which interfaces with the frame base 41 of the quilting frame 33 and thereby provides for the back and forth x dimension motion 39 of the sewing machine carriage 35 and the sewing machine 36. The drive mechanism and the interface between the sewing machine carriage 35 and the quilting frame 33 may consist of a ratchet drive, a screw drive, a roller drive, or other drive mechanism which will be known to persons skilled in the art. Other methods and devices for interfacing the sewing machine carriage and the quilting frame and providing for the x dimension movement of the sewing machine carriage on the quilting frame will be known to persons of ordinary skill in the art.

Figure 4:
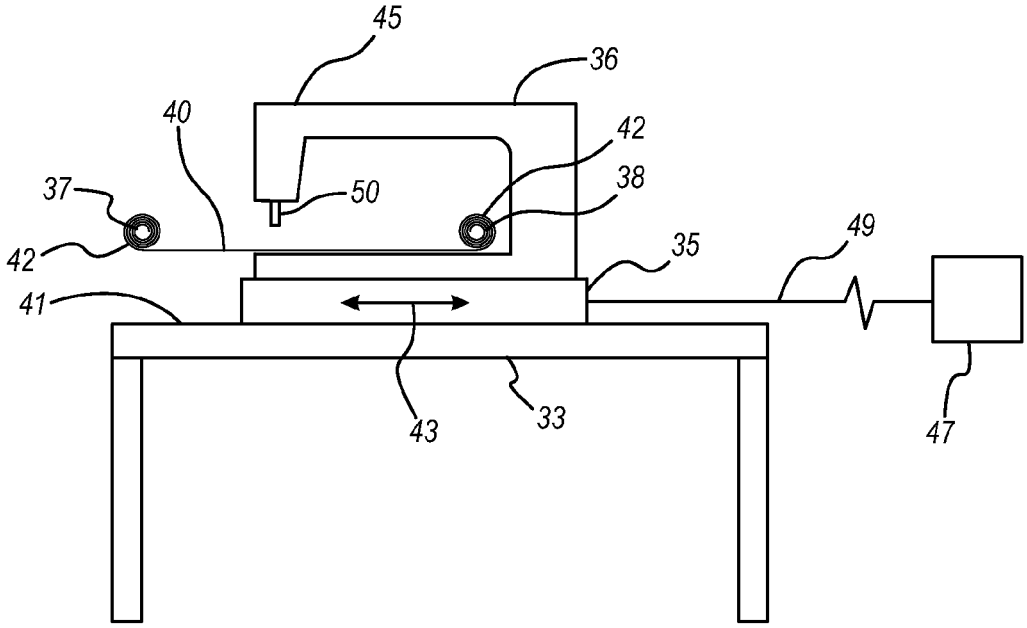
FIG. 4 is a side view, cross-section illustration of a mechanized quilting frame employing a preferred embodiment of the method and apparatus of the present invention, with the sewing machine in the maximum forward position.

Referring now to FIG. 4, a side view cross-section illustration of the quilting frame 33 with frame base 41 which interacts with the motorized sewing machine carriage 35. The sewing machine carriage 35, which also typically has a y dimension motor and drive mechanism which provides for the back and forth y dimension motion 43 of the sewing machine carriage 35, or a portion thereof, and the sewing machine 36. The feed rail 37 and the take up rail 38 are each shown with a fabric roll 42 of fabric 40, which would be present during a normal sewing operation. The sewing machine carriage 35 and the sewing machine 36 are shown in FIG. 4 with the sewing machine 36 in its maximum forward position 45.

Figure 5:
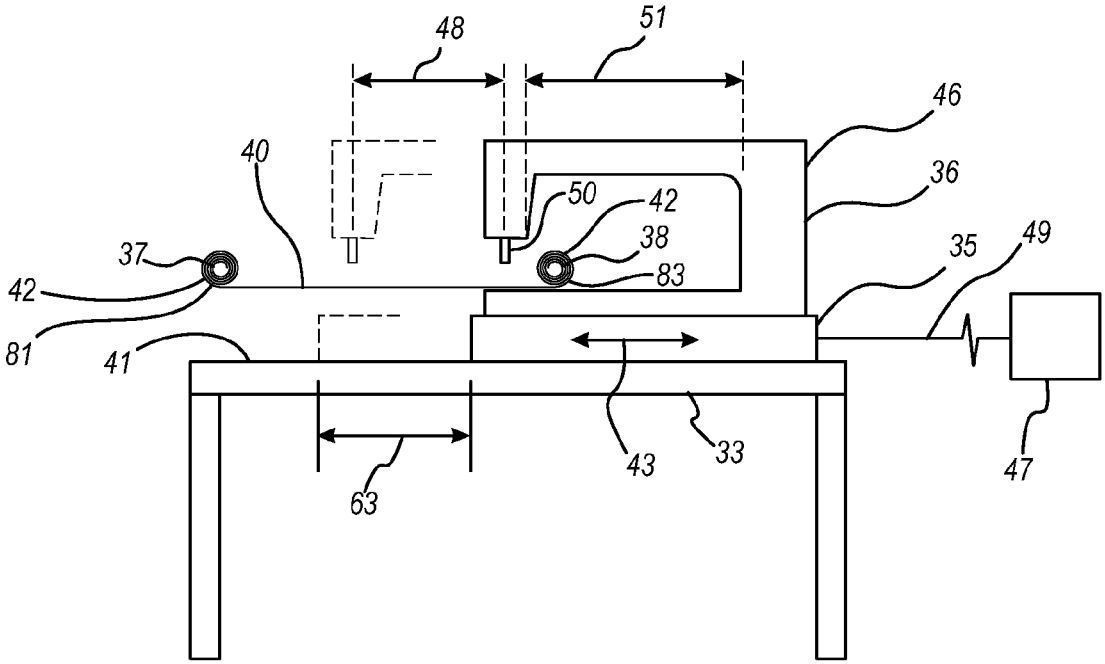
FIG. 5 is a side view, cross-section illustration of a mechanized quilting frame employing a preferred embodiment of the method and apparatus of the present invention, with the sewing machine in the maximum rearward position.

Referring now to FIG. 5, the sewing machine carriage 35 and the sewing machine 36 are shown in the sewing machine maximum rearward position 46. The maximum y dimension needle bar travel 48 of the needle bar 50 y dimension movement 43 that would be allowable during the normal sewing operation will depend upon the amount of fabric 40 and thus the diameter of the fabric roll 42 on the take up rail 38. The maximum y dimension needle bar travel 48 may also be referred to as the available throat length 48.

The structure and components of the sewing machine carriage 35, including any variations thereof, including any motors, gears, and alternative drive mechanisms, providing for interface of the sewing machine carriage 35 with the quilting frame 33, and providing for the automated movement of the sewing machine 36 in the x and y dimensions on the quilting frame, as well as the structure of the quilting frame itself, will be known to persons of ordinary skill in the art, and therefore those structural and mechanical details are not shown in the drawings or described in detail in this specification. Neither embodiments of the method nor embodiments of the apparatus of the present invention are dependent on or limited to any particular structure for the quilting frame or the sewing machine carriage.

It must also be noted that although, for illustrative purposes, the embodiments of the method and apparatus of the present invention shown in FIGS. 3-5, incorporate a feed mechanism comprising a simple, single feed rail 37, and a take up mechanism comprising a simple, single take up rail 29. Other feed mechanisms other than a single feed rail and other take up mechanisms other than a single take up rail will be known to persons of ordinary skill in the art, in view of the disclosures of this detailed description. Neither embodiments of the method nor embodiments of the apparatus of the present invention are dependent on or limited to any particular structure for the feed mechanism or the take up mechanism. For example, the feed method and mechanism may utilize multiple feed rails with a fabric layer on and being fed from each rail, or may be as simple as draping the fabric over the edge of the structure that the sewing machine carriage is mounted on. The take up method and mechanism may also utilize multiple rails, for example, one to position the fabric for proper sewing and another to take up the sewed fabric. The feed method and mechanism and the take up method and mechanism, respectively, may comprise any method or mechanism, respectively, providing for securing the fabric in position so that the sewing machine may be moved with respect to the positioned fabric in the x dimension and the y dimension as required to position the sewing machine for sewing the desired pattern. The method and apparatus of the present invention may also utilize any fabric retaining mechanism and any sewing machine positioning mechanism that can provide for the retention of the fabric for sewing, and for the positioning of the sewing machine with respect to the retained fabric or the positioning of the retained fabric with respect to the sewing machine.

Referring again to FIG. 3, an actuator 47 is indicated, which may be connected to the sewing machine carriage by wire 49, such as a USB wire interface, or by wireless interface. The actuator 47 provides the control signal to the sewing machine carriage, thereby controlling the x dimension movement and the y dimension movement of the sewing machine carriage, and simultaneously controlling the operation of the needle bar of the sewing machine. By controlling the x dimension and y dimension movement of the sewing machine carriage and the operation of the needle bar, automated positioning of the stitching and the automated stitching for the desired sewing pattern can be achieved.

The actuator may be an independent, external PC or computer network. The actuator may also be a dedicated computer used solely for the purpose of controlling the sewing machine carriage and the sewing machine. The sewing pattern may be input to and stored in memory in the actuator, or may be accessed by the actuator in a separate or remote database.

Figure 6:
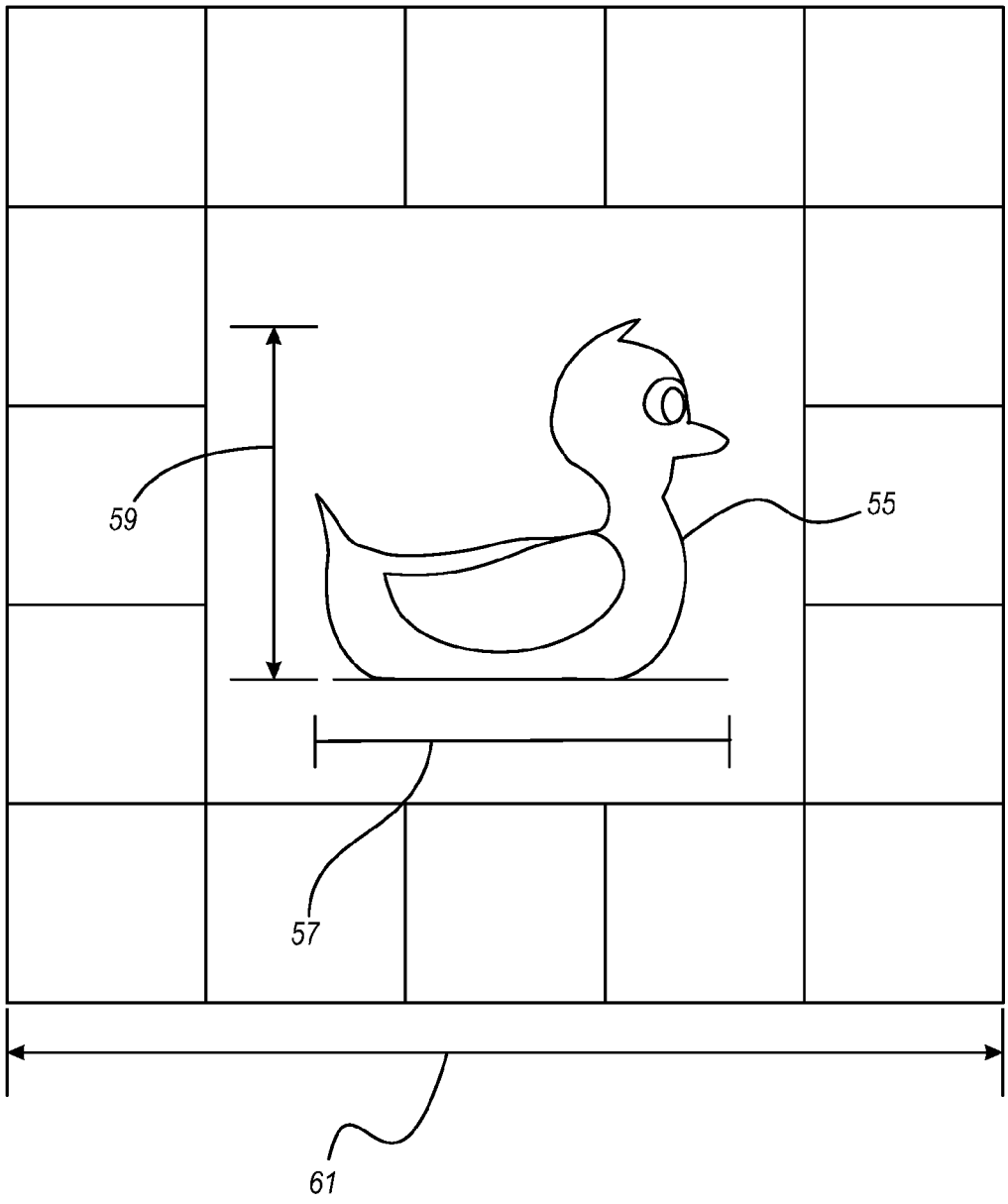
FIG. 6 is a plan view illustration of an example of an oversize quilt pattern or other sewing pattern.

Referring again to FIG. 4, as mentioned previously, a primary difficulty and limitation with automated quilting or automated sewing of other items arises from the limitation imposed on y dimension movement 43 of the sewing machine carriage 35 and thus the sewing machine 36. Referring also to FIG. 6, an illustration of a quilt pattern or other sewing pattern 55 is shown with a pattern width 57 and a pattern length 59. So long as the pattern width 57 is less than the quilt or other sewing item width 61 and the mechanized quilting or sewing frame accommodates the full width of the quilt or other sewing item, then the x dimension movement 39 is not a problem for a typical automated quilting or sewing frame. The difficulty arises when the pattern length 59 is greater than the maximum y dimension needle bar travel 48, which is limited by the available throat length 51. The available throat length 51 may be determined based on the throat length 13, the amount of fabric 40 on the take-up rail 38, and the diameter of the fabric roll 42.

Figure 7:
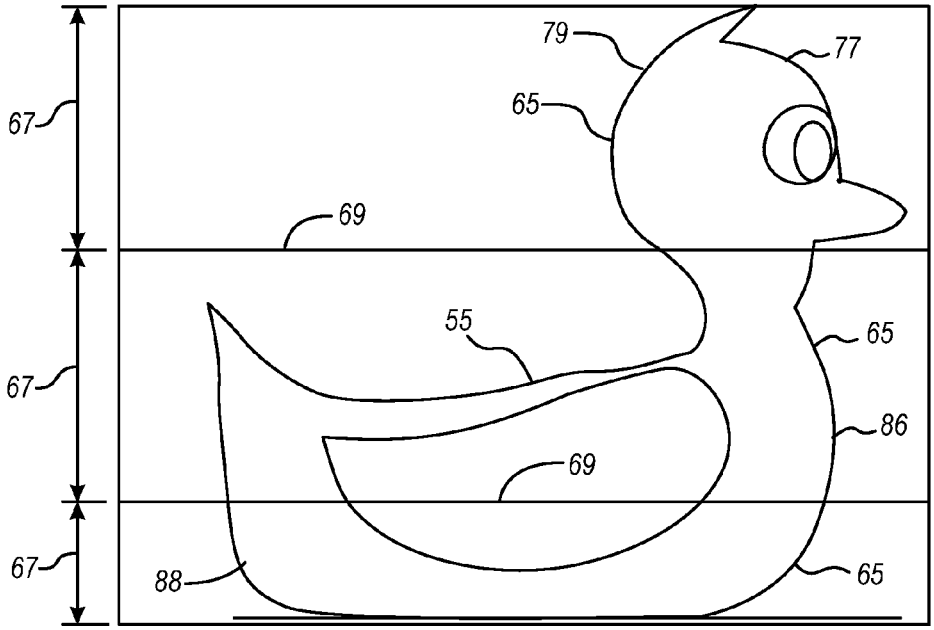
FIG. 7 is a plan view of the sewing pattern of FIG. 6 segmented into pattern segments by the method and apparatus of the present invention.

Referring also now to FIG. 7, the method and apparatus of the present invention provides for the dividing of the sewing pattern 55 to the pattern segments 65, with the segment length 67 of each of the pattern segments 65 being less than or equal to maximum y dimension needle bar travel 48. Simplified embodiments of the method and apparatus of the present invention require the user to select the pattern segment borders 69 between the respective pattern segments 65. However, preferred embodiments of the method and apparatus of the present invention will provide for the automated selection of segment borders 69 by the actuator 47, or may provide for the user to have the option of manually selecting one or more of the segment borders and having the actuator 47 select one or more of the segment borders.

Figure 8:
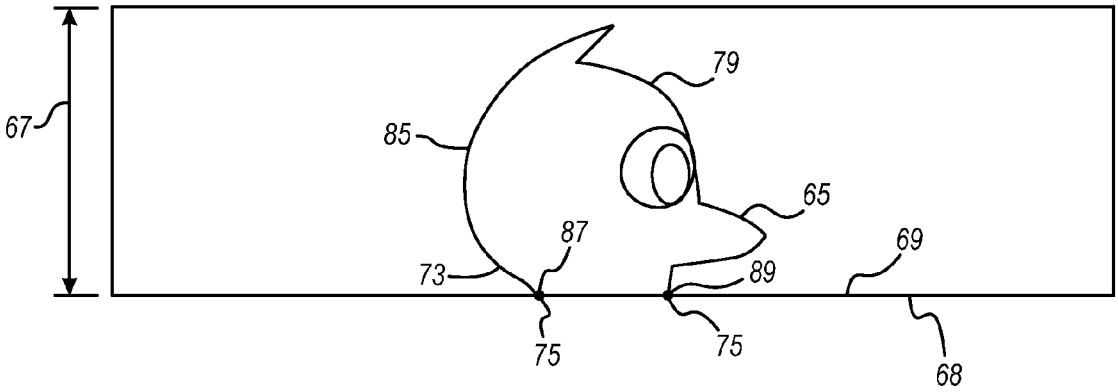
FIG. 8 is a plan view of a first pattern segment of the pattern segments shown in FIG. 7.

Referring also now to FIG. 8, for some preferred embodiments, the actuator 47 may have a pattern program with a segmentation algorithm which will attempt to optimize the segment border 69 selection. The segmentation algorithm may rely on variables such as the number of pattern lines 73 that will be cut by the segment border 69, and the position of the cut points 75 to optimize the segment border selection. Other embodiments of the pattern program may provide simply for the division of the pattern into the pattern segments of equal length. Generally, however, preferred embodiments of the pattern program may attempt to optimize the segment borders 69 by minimizing the number of cut points 75. As will be described below, this will reduce the amount of time and effort required by the user in progressing from one pattern segment 65 to the next.

Referring again to FIG. 7 and also to FIG. 5, a preferred embodiment of the apparatus of the present invention may include an actuator 47 with a pattern program that will display the selected pattern 77 and display the segment borders 69. The user may have previously input the maximum y dimension needle bar travel 48, which is the maximum y dimension movement 63 of the sewing machine carriage, and which may be equal to or dependent on the available throat length 51. Preferred embodiments may initially divide the pattern 77 into pattern segments 65 of equal segment length 67. The pattern program may then allow the user to move the segment borders 69 to a different position desired by the user. If the embodiment of the pattern program provides such a manual override by the user, the pattern program will indicate the insertion of an additional segment border 69 if the manual repositioning of the segment border results in the maximum y dimension movement 63 being exceeded.

Other preferred embodiments of the method and apparatus of the present invention may provide for the pattern program to initially attempt to optimize the location of the segment borders, thereby minimizing the number of cut points 75. The pattern program may display, on an actuator screen, the pattern 77 and the initial selection of segment borders 69. The pattern program may also display, on an actuator screen, the location of the segment borders if the pattern is segmented into pattern segments of equal length and simultaneously indicate, perhaps by a different color line, the segment borders that the pattern program determines to be the optimal location, perhaps based on the locations which minimize the number of cut points.

The sewing pattern selected by the user may be obtained by the user from a number of sources. Electronic data bases containing multiple patterns that a user may select from for automated quilting frame are readily available. Systems are also known that allow the user to generate a digital pattern using a computer aided drafting program. Other systems are also known that provide for the user to manually trace a pattern using an electronic stylus that will digitize the pattern based upon the manual movement of the stylus. Regardless of whether the user selects a pattern from an electronic catalog, generates the pattern through the use of a CAD system or similar system, or generates the pattern through some other method that will be known to persons of skill in the art, the end result will be a digital representation of a pattern which may be accessed by the pattern program of an embodiment of the present invention. The pattern will be displayed on a computer monitor and the segment borders established entirely by user selection, by a combination of pattern program initial segment border selections and subsequent user modification, or may be entirely pattern program determined to achieve equal segment lengths or to achieve an optimization objective.

Regardless of the embodiment method, once the segment borders have been selected, the user may proceed to the sewing of the pattern. The user may select to sew the pattern segments in any order, but a preferred method would be to start with the top pattern segment and work down or to start with the bottom pattern segment and work up.

Referring now to FIG. 8, a top pattern segment 79 of the pattern shown in FIG. 7, is illustrated. Referring again also to FIG. 5, once the fabric 40 is in position on the feed rail 37, forming a feed rail fabric roll 81 and the fabric 40 is fed into the throat of the sewing machine 36 and rolled onto the take up rail 38 thereby forming the take up rail fabric roll 83, if the user is starting at the top pattern segment, the fabric is fed onto and rolled onto the take up rail in sufficient quantity to appropriately position the top pattern segment. The pattern program is then actuated and the top pattern segment stitching 85 is sewn into the fabric 40. Additional fabric is then rolled onto to the take up rail 38, positioning the fabric 40 for the stitching of the second pattern segment 86.

Figure 9:
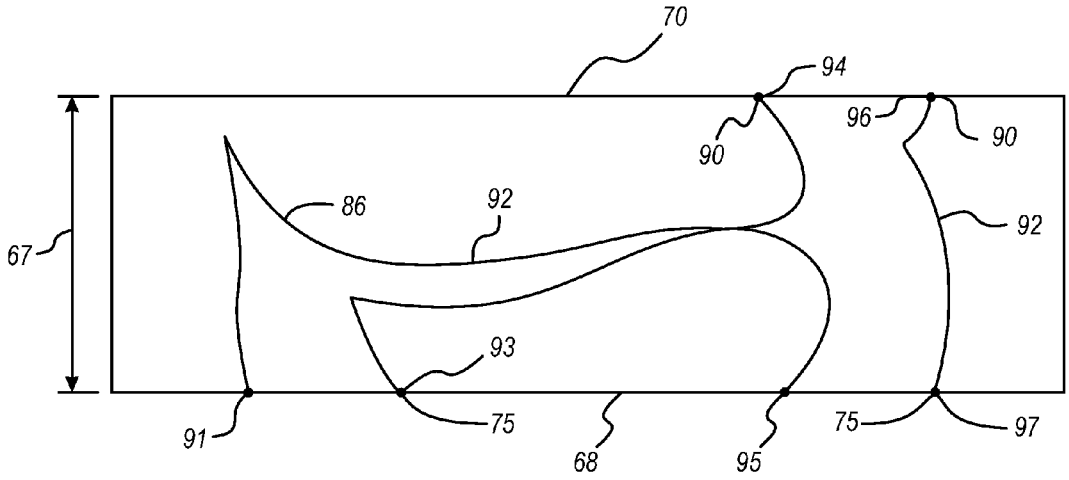
FIG. 9 is a plan view of a second pattern segment shown in FIG. 7.

Referring also to FIG. 9, for the pattern shown the top pattern segment has two cut points 75 at its segment first border 68. Cut point one 87 and cut point two 89 which must be precisely matched by the start points 90 for the stitching of the second pattern segment 86. In one preferred embodiment of the method and apparatus of the present invention, once the fabric 40 has been advanced onto the take up rail 38, thereby positioning the second pattern segment 86 for stitching, the user will manually move the needle to be positioned, sequentially, to the each of the two cut points, cut point one 87 and cut point two 89. When positioning the needle immediately over cut point one 87, the user confirms, at the actuator 47, for the pattern program that the needle is at the cut point one 87 position. Then the user manually moves the needle to the cut point two 89 position and confirms for the pattern program that the needle is now positioned at the cut point two 89 position. The pattern lines 92 for the second pattern segment 86 are then adjusted by the pattern program to match the first start point 94 to the first cut point 87, and the second start point 96 to match second cut point 89. The overall pattern for the second pattern segment 86 is then adjusted to preserve the proportionality, overall presentation, and appearance of the second pattern segment 86. This preferred method of the present invention provides the additional benefit of ensuring that the correct orientation of the second pattern segment with respect to the first pattern segment is preserved. Therefore, not only will the cut points be matched to the start points, but the orientation between the second pattern segment and the first pattern segment will match the original pattern as selected by the user.

Other embodiments of the method and apparatus of the present invention may provide for the actuator to pre-position the needle bar at a trial position for a start point, with the user then moving the needle bar from the trial position to the actual position of the corresponding cut point. More sophisticated embodiments may provide for the actuator to pre-position the needle bar at a trial position for a start point, for an optical sensor or the like to sense the actual position of the corresponding cut point, and for the actuator to move the needle bar from the trial position to the actual corresponding cut point position. The user may then confirm that the needle bar is correctly positioned and the actuator may digitize the adjusted start point. This may then be repeated for any other adjacent pattern segment.

Because of the inherent nature of fabric, i.e., it stretches and bunches, the respective dimensioning between cut point one and cut point two as originally sewn for the top pattern segment may be altered as the fabric is advanced onto the take up rail. Therefore an essential step of the method and the function of the pattern program is that once the fabric has been advanced and the cut points are located and confirmed for the pattern program, the stitching of the second pattern segment begins at the manually located cut point locations as opposed to the pattern program attempting to maintain the design dimensions and design orientation of cut point one with respect to cut point two. So not only may the distance between the two cut points be changed due to the characteristics of the fabric and advancing the fabric onto the take up rail, the angular orientation of cut point two with respect to cut point one may be altered. Therefore it is essential that the stitching of the second pattern segment start at the actual cut point location as opposed to a theoretical cut point location.

Once the matching of the cut points of the first pattern segment with the start points of the second pattern segment is accomplished, and the overall adjustment of the pattern lines of the second segment is accomplished, the pattern program is actuated for sewing of the pattern for the second segment. The order of sewing of the lines of the second pattern segment can either be manually selected by the user under certain embodiments or the order of stitching the pattern lines of segment two may be determined by the pattern program. Once the second pattern segment has been stitched, the fabric 40 is once again advanced from the feed rail 37 to the take up rail 38 to a position appropriate for the stitching of the third pattern segment 88.

Referring again to FIG. 9, the pattern lines 92 of the second pattern segment 86 are shown. The matching of start points one and two 94, 96, at the segment second border 70 for this pattern segment, with cut points one and two 87, 89, thereby provides for the matching of the pattern lines of the first segment with the pattern lines of the second segment. It will be noted that, for this illustration, there are four cut points 90, namely cut point three 91, cut point four 93, cut point five 95 and cut point six 97 that must be matched at the segment first border 68 for this pattern segment for the transition between the second pattern segment 86 and the third pattern segment 88 shown on FIG. 10.

As described previously, under one preferred embodiment of the method of the present invention, after the fabric 40 is further advanced from the feed rail 37 to the take-up rail 38 and appropriately positioned for the third pattern segment 88, the user manually positions the needle sequentially at each of the cut points three, four, five and six, and upon positioning the needle at each of these points, confirms to the pattern program, the respective positions of these cut points.

Figure 10:
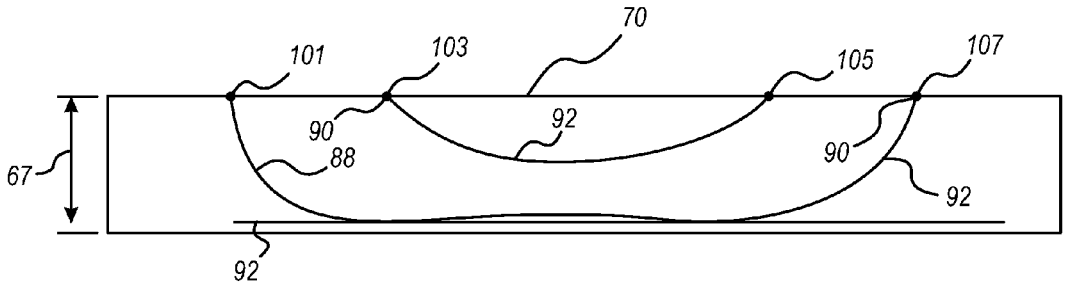
FIG. 10 is a plan view of a third pattern segment shown in FIG. 7.

Referring to FIG. 10, as was previously completed for the interface between the top pattern segment 77 and the second pattern segment 86, the determination and confirmation of the actual positions of cut points three, four, five and six 91, 93, 95, 97, and the adjustment by the pattern program of the respective positions of start points three, four, five and six 101, 103, 105, 107 will ensure that the stitching of the pattern lines 92 in the third pattern segment 88 will match the stitching of those pattern lines 92 in the second pattern segment 86 regardless of any deformation in the pattern that may incur due to the inherent characteristics of the fabric. Therefore, regardless of whether the fabric between the cut points is more stretched or more bunched or angularly rotated from the position they were when they were first sewn for pattern segment two, the stitching for pattern segment three 88 will commence at the respective cut point locations thereby preserving the continuity of the lines. As for the stitching of the second pattern segment 86, the order of stitching of the pattern lines 92 of the third pattern segment 88 may be determined manually by the user or may be determined by the pattern program.

Preferred embodiments of the method of the present invention may also provide for the user, upon completion of the sewing of a pattern segment and the advancement of the fabric for the next pattern segment, to rely on the pattern program to move the sewing machine needle to the theoretically correct physical location of the cut point where the sewing should start. The pattern program captures the difference between where the needle might be theoretically positioned and the actual position of the cut point. The pattern program then determines the appropriate adjustment in the stitching of the next segment to maintain the overall integrity of the stitched pattern. The ability of the pattern program to adjust the stitching of the pattern segments to match the cut points and the start points is an essential feature of the method and apparatus of the present invention.

The pattern program provides for the user to precisely match the cut points of each sewed pattern segment with the start points for the stitching of the corresponding lines of the subsequent pattern segment. A start point alignment algorithm of the pattern program actually performs a pattern distortion so that the start points of the subsequent pattern segment will precisely match the cut points of the pattern lines of the previously stitched pattern segment. This is accomplished by the algorithm stretching or shrinking the pattern longitudinally or laterally, or both, to get the cut points and the start points to match between contiguous pattern segments.

The foregoing illustration of the method and apparatus of the present invention is a three pattern segment example. However, the process indicated between the top pattern segment and the second pattern segment and between the second pattern segment and the third pattern segment is the process that would be repeated for each pattern segment regardless of the number of pattern segments involved. Regardless of the number of pattern segments, the end result will be a finished pattern where all of the pattern stitching for pattern lines which transition from one pattern segment to another are continuous and appropriately aligned while the adjustments made by the pattern program algorithms may result in a stitched pattern which varies dimensionally from the pattern selected by the user, the overall intent would be of the pattern and the presentation of the pattern will be preserved.

The illustration of the method described above is for beginning with the top pattern segment and progressing down segment by segment to the bottom pattern segment. However, the method could involve starting with any of the segments and progressing to the other segments in any order. For instance, the user could start with the bottom segment and progress to the top segment next and finish by filling in with the segments between the top segment and the bottom segment. However, if the start point alignment algorithm has to make adjustments for matching to both top cut points and bottom cut points for a pattern segment, the extent of the pattern distortion may be greater for that segment. The end result may be an overall pattern which varies from the selected pattern by a greater degree than would be the case if the user started with the top segment or bottom segment and proceeded in an orderly fashion to contiguous segments.

Figure 11:
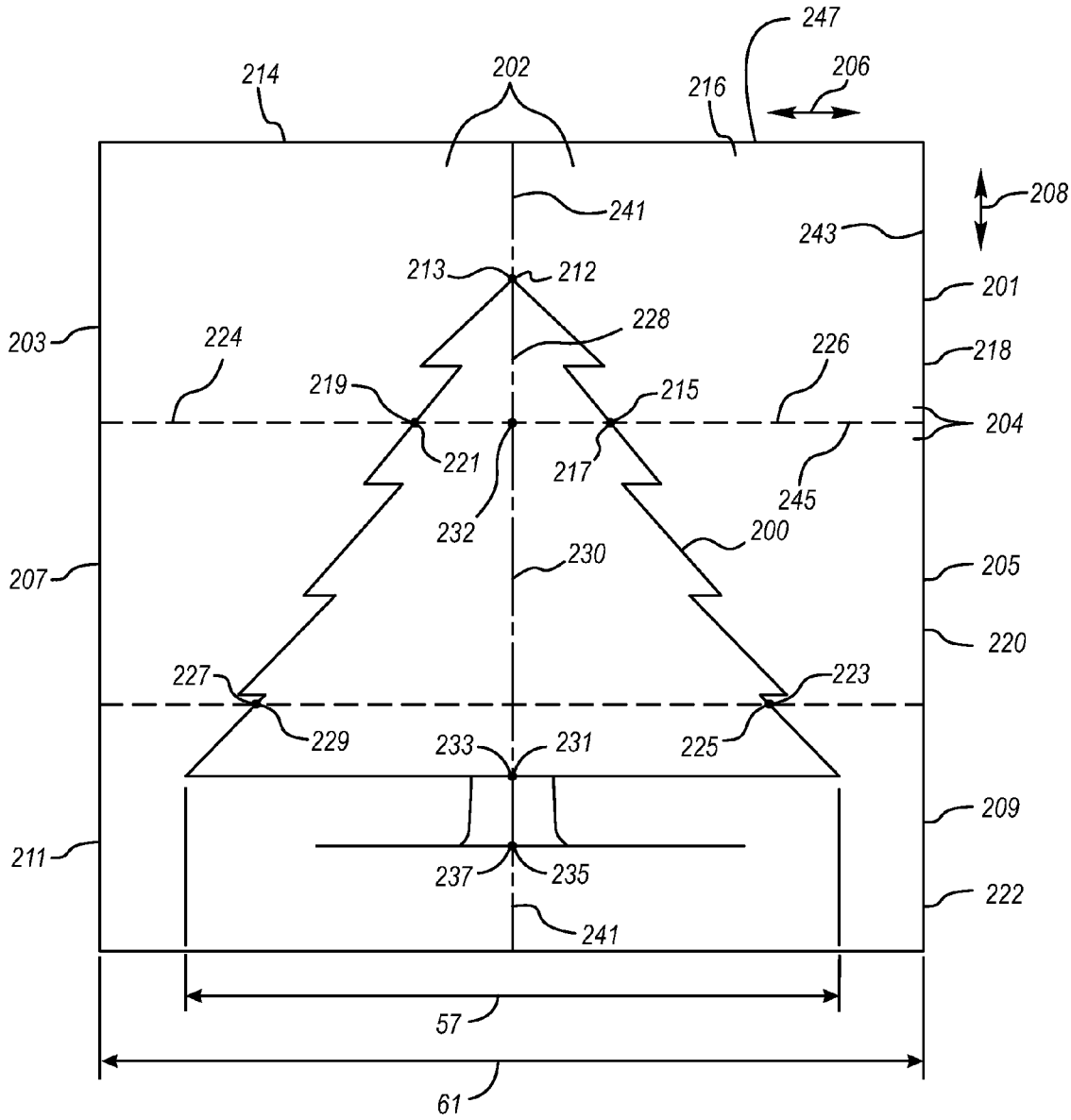
FIG. 11 is a plan view illustration of an oversize sewing pattern segmented longitudinally and laterally by the method and apparatus of the present invention.

Referring now to FIG. 11, additional variations of the method and apparatus of the present invention provide for accommodating a pattern 200 having a pattern width 57 that exceeds the maximum x dimension movement, also referred to as the maximum lateral movement, of the sewing machine with respect to a quilting frame or other fabric retention mechanism. For those embodiments, the pattern 200 may be segmented laterally 202, in the x dimension 206, and longitudinally 204, in the y dimension 208. The pattern shown in FIG. 11 illustrates a pattern 200 segmented laterally 202 into two lateral segments 214, 216, and segmented longitudinally into three longitudinal segments 218, 220, 222. However, the method and apparatus of the present invention provide for a pattern to be segmented into two or more lateral segments and two or more longitudinal segments. Further, the pattern may be segmented only longitudinally as shown in FIGS. 7-10, or only laterally.

Referring again to FIG. 11, this figure illustrates one pattern segment 201 having one lateral cut point 212 along one side of the pattern segment, the first lateral border 241 in addition to a cut point 215 along the bottom of the pattern segment, the first longitudinal border 245. This pattern segment has no cut points on its second longitudinal border 247 and no lateral cut points on its second lateral border 243. Another pattern segment 209 has two lateral cut points 231, 235 on its first lateral border 241. Assuming, for example, that the pattern segments are sewn in the following order, 201-205-209-203-207-211, the method and apparatus of the present invention may provide for a lateral start point 213 of laterally adjacent pattern segment 203 to be matched with the lateral cut point 212 of laterally adjacent pattern segment 201, and for start point 217 of pattern segment 205 to be matched with cut point 215 of longitudinally adjacent pattern segment 201. Further, the method and apparatus of the present invention may provide for lateral start points 233, 237 of pattern segment 211 to be matched with lateral cut points 231, 235 of laterally adjacent pattern segment 209, and for start point 229 of pattern segment 211 to be matched with cut point 227 of longitudinally adjacent pattern segment 207 and for start point 225 of pattern segment 209 to be matched with cut point 223 of longitudinally adjacent pattern segment 205.

Although the description of the use of the method of the present invention, for a pattern that is segmented longitudinally and laterally, presented above, illustrates the use of a particular order in the sewing of the pattern segments, as described previously, any order can be used. The key required step is that, regardless of the order used, after the fabric is repositioned, the pattern start points of a pattern segment to be sewed must be matched to the pattern cut points of any previously sewed, longitudinally adjacent pattern segment, and the pattern lateral start points of the segment to be sewed must be matched to the pattern lateral cut points of any previously sewed, laterally adjacent pattern segment. This is accomplished by the user, after the fabric is repositioned and secured following the sewing of a pattern segment, positioning the needle bar at all cut points and all lateral cut points, respectively, of previously sewed adjacent pattern segments, and thereby generate digitized start points and digitized lateral start points for the pattern segment to be sewed which will match the start points and lateral start points to the cut points and lateral cut points, respectively, of the previously sewed, adjacent pattern segments. The sewing pattern is adjusted by the pattern program to fit the start points and the lateral start points.

Figure 12:
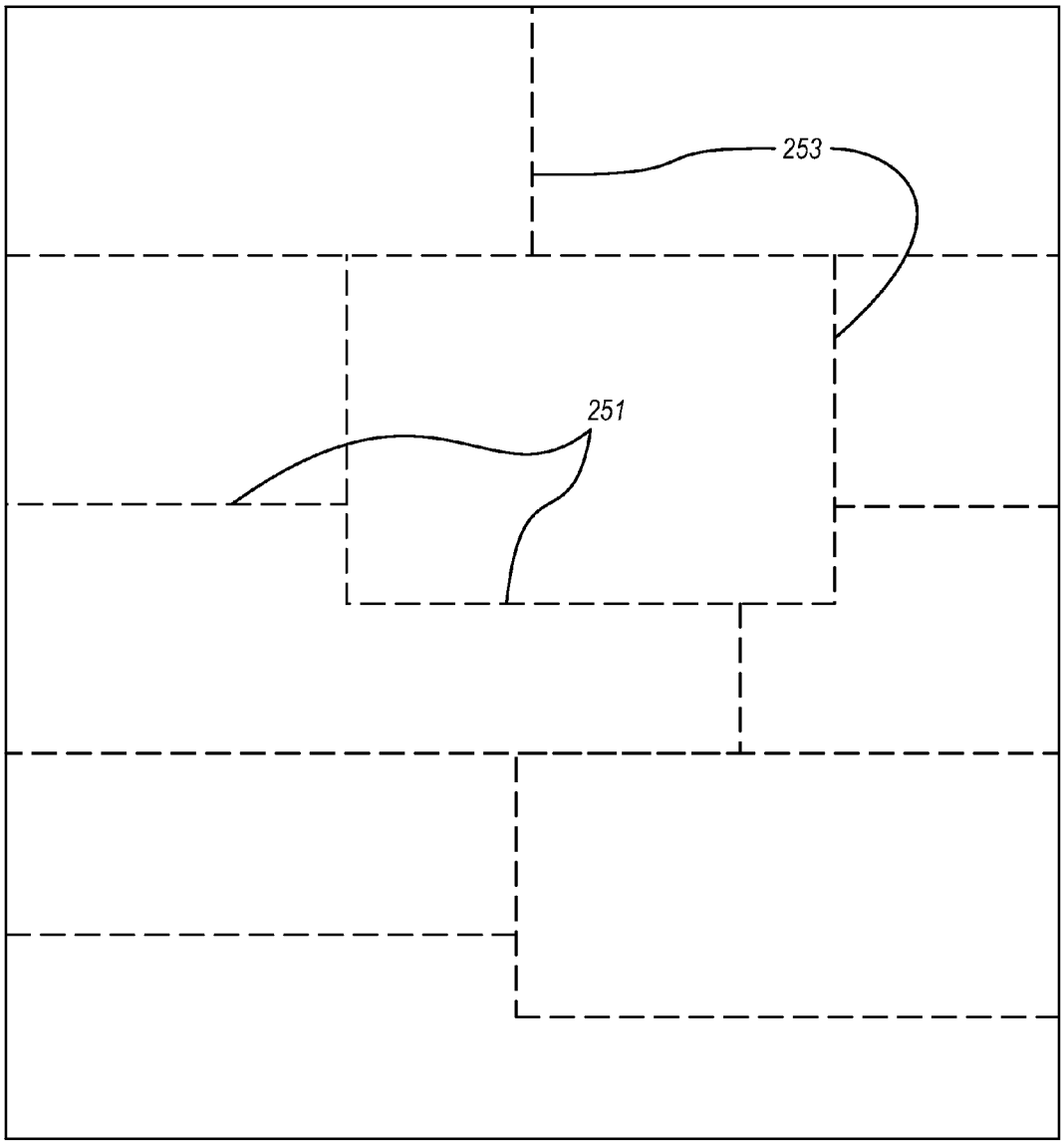
FIG. 12 is a plan view illustration of an oversize sewing pattern segmented longitudinally and laterally by the method and apparatus of the present invention, with the pattern segment borders being non-aligned.

Referring again to FIG. 11, for the pattern segmentation shown in this figure, the lateral pattern segmentation lines, for example first lateral segmentation line 228 and second lateral segmentation line 230 are aligned laterally, and first longitudinal segmentation line 226 and second longitudinal segmentation line 224 are aligned longitudinally, resulting in lateral segmentation line 228, lateral segmentation line 230, longitudinal segmentation line 224, and longitudinal segmentation line 226 intersecting at a segmentation junction point 232. However, the present invention is not limited to pattern segmentation having aligned longitudinal pattern segmentation lines or aligned lateral segmentation lines. As shown in FIG. 12, longitudinal pattern segmentation lines 251 and lateral pattern segmentation lines 253 may be non-aligned.

Additional embodiments of the method and apparatus of the present invention may incorporate a fabric hoop to retain the fabric in a desired position for sewing. For those embodiments, either the sewing machine may be controlled by an actuator and moved by a sewing machine carriage in the x dimension and the y dimension as required to position the sewing machine for sewing the desired pattern, or, alternatively, the sewing machine may be stationary and the fabric hoop position may be controlled by an actuator and moved in the x dimension and the y dimension as required to position the hoop for sewing the desired pattern.

The method and apparatus of the present invention may utilize any fabric retention mechanism and any sewing machine positioning system, so long as: (a) the fabric can be securely positioned and repositioned as the user progresses from pattern segment to pattern segment; (b) the user can position the needle bar at all cut points and all lateral cut points, respectively, of previously sewed adjacent pattern segments, and thereby generate digitized start points for the pattern segment to be sewed which will match the start points and lateral start points to the cut points and lateral cut points, respectively, of the previously sewed, adjacent pattern segments; and (c) the actuator can move the sewing machine, or the fabric retention mechanism, to follow the pattern within the pattern segment, as adjusted to provide for matching of the start points to the cut points of longitudinally adjacent pattern segments, and the lateral start points to the lateral cut points of laterally adjacent pattern segments.

The foregoing method and apparatus has been illustrated and described in particular for use in sewing a quilt pattern on multiple layers of fabric. However, the foregoing method and apparatus may be used for sewing a pattern on any fabric, multiple layers or single layers. For example, in addition to quilting, it can be used for embroidery involving only one layer of fabric.

The foregoing method and apparatus has been illustrated and described for use in sewing. However, as will be known to persons of ordinary skill in the art, a fabric cutting device may be attached to a sewing machine needle bar and the sewing machine thereby used for cutting fabric. If a pattern is to be cut, a digitized cut pattern is used which includes gaps in the cut pattern where the fabric is not cut, in order to retain the fabric in position as the fabric is being cut. The foregoing method and apparatus may be used for segmenting and matching a cut pattern in the same manner as described and shown for segmenting and matching a sewing pattern, and for cutting the fabric to the segmented and matched cut pattern in the manner described and shown for sewing a segmented and matched sewing pattern.

Other embodiments and other variations and modifications of the embodiments described above will be obvious to a person skilled in the art. Therefore, the foregoing is intended to be merely illustrative of the invention and the invention is limited only by the following claims and the doctrine of equivalents.

What is claimed is:

1. A method for automated assisted sewing of an oversized, digitized sewing pattern selected by a user, using a fabric retention mechanism and an automated sewing machine positioning mechanism, the sewing machine positioning mechanism being controlled by an actuator and providing for two dimensional positioning of a sewing machine with respect to the fabric retention mechanism, the sewing machine having an available throat length and a needle bar, the sewing pattern having a pattern length which is greater than the available throat length or a pattern width which is greater than a maximum lateral movement of the sewing machine with respect to the fabric retention mechanism, or both, the sewing pattern having one or more pattern lines, the method comprising:

providing the digitized sewing pattern to the actuator;

segmenting the sewing pattern into a plurality of digitized pattern segments, each pattern segment having a segment length which is equal to or less than the available throat length, and a segment width which is equal to or less than the maximum lateral movement of the sewing machine with respect to the fabric retention mechanism, each pattern segment having a segment first border, a segment second border, a segment first lateral border, and a segment second lateral border;

selecting an order for the sequential sewing of the respective pattern segments;

positioning the fabric on the fabric retention mechanism as required to position the fabric for a pattern segment to be sewed;

positioning the needle bar consecutively at each cut point, respectively, if any, of each previously sewed pattern segment which is longitudinally adjacent to the pattern segment to be sewed, and at each lateral cut point, respectively, if any, of each previously sewed pattern segment which is laterally adjacent to the pattern segment to be sewed, and digitizing each such cut point, if any, and each such lateral cut point, if any;

generating a digitized start point, respectively, for each digitized cut point and a digitized lateral start point, respectively, for each digitized lateral cut point, for the pattern segment to be sewed, matching each digitized start point to the corresponding digitized cut point, and matching each digitized lateral start to the corresponding digitized lateral cut point;

adjusting the pattern lines of the pattern segment to be sewed to fit the pattern lines to the digitized start points and the digitized lateral start points;

sewing the adjusted pattern lines of the pattern segment to be sewed;

repeating the foregoing for each pattern segment consecutively in the order selected until all of the pattern segments are sewed, beginning with positioning the fabric on the fabric retention mechanism as required to position the fabric for the pattern segment to be sewed.

2. The method of claim 1 wherein generating a digitized start point, respectively, for each digitized cut point and a digitized lateral start point, respectively, for each digitized lateral cut point, for the pattern segment to be sewed, matching each digitized start point to the corresponding digitized cut point, and matching each digitized lateral start to the corresponding digitized lateral cut point, includes identifying a cut point for each point where a pattern line of a previously sewed pattern segment crosses a segment first border of a previously sewed, longitudinally adjacent pattern segment which is to be adjacent to a segment second border of the pattern segment to be sewed, or crosses a segment second border of a previously sewed, longitudinally adjacent pattern segment which is to be adjacent to a segment first border of the pattern segment to be sewed, and further identifying a lateral cut point for each point where a pattern line of a previously sewed, laterally adjacent pattern segment crosses the segment first lateral border of the previously sewed, laterally adjacent pattern segment which is to be adjacent to a segment second lateral border of the pattern segment to be sewed, or crosses a segment second lateral border of a previously sewed, laterally adjacent pattern segment which is to be adjacent to a segment first lateral border of the pattern segment to be sewed.

3. An apparatus for automated assisted sewing of an oversized, digitized sewing pattern selected by a user, using a fabric retention mechanism and an automated sewing machine positioning mechanism, the sewing machine having an available throat length and a needle bar, the sewing pattern having a pattern length which is greater than the available throat length or a pattern width which is greater than a maximum lateral movement of the sewing machine with respect to the fabric retention mechanism, or both, the sewing pattern having one or more pattern lines, the apparatus comprising:

an actuator for controlling the sewing machine positioning mechanism and providing for two dimensional positioning of a sewing machine with respect to the fabric retention mechanism;

an actuator access to a digitized quilt pattern;

a pattern program for segmenting the sewing pattern into a plurality of digitized pattern segments, each pattern segment having a segment length which is equal to or less than the available throat length, and a segment width which is equal to or less than the maximum lateral movement of the sewing machine with respect to the fabric retention mechanism, each pattern segment having a segment first border, a segment second border, a segment first lateral border, and a segment second lateral border;

receiving or selecting an order for the sequential sewing of the respective pattern segments;

providing for the positioning the needle bar consecutively at each cut point, respectively, if any, of each previously sewed pattern segment which is longitudinally adjacent to the pattern segment to be sewed, and at each lateral cut point, respectively, if any, of each previously sewed pattern segment which is laterally adjacent to the pattern segment to be sewed, and digitizing each such cut point, if any, and each such lateral cut point, if any;

generating a digitized start point, respectively, for each digitized cut point and a digitized lateral start point, respectively, for each digitized lateral cut point, for the pattern segment to be sewed, matching each digitized start point to the corresponding digitized cut point, and matching each digitized lateral start to the corresponding digitized lateral cut point;

adjusting the pattern lines of the pattern segment to be sewed to fit the pattern lines to the digitized start points and the digitized lateral start points;

sewing the adjusted pattern lines of the pattern segment to be sewed;

repeating the foregoing for each pattern segment consecutively in the order selected until all of the pattern segments are sewed, beginning with positioning the fabric on the fabric retention mechanism as required to position the fabric for the pattern segment to be sewed.

4. The apparatus of claim 3 wherein the pattern program, in providing for generating a digitized start point, respectively, for each digitized cut point and a digitized lateral start point, respectively, for each digitized lateral cut point, for the pattern segment to be sewed, matching each digitized start point to the corresponding digitized cut point, and matching each digitized lateral start to the corresponding digitized lateral cut point, includes identifying a cut point for each point where a pattern line of a previously sewed pattern segment crosses a segment first border of a previously sewed, longitudinally adjacent pattern segment which is to be adjacent to a segment second border of the pattern segment to be sewed, or crosses a segment second border of a previously sewed, longitudinally adjacent pattern segment which is to be adjacent to a segment first border of the pattern segment to be sewed, and further identifying a lateral cut point for each point where a pattern line of a previously sewed, laterally adjacent pattern segment crosses the segment first lateral border of the previously sewed, laterally adjacent pattern segment which is to be adjacent to a segment second lateral border of the pattern segment to be sewed, or crosses a segment second lateral border of a previously sewed, laterally adjacent pattern segment which is to be adjacent to a segment first lateral border of the pattern segment to be sewed.

5. A method for a user to use a mechanized frame for automated sewing on fabric of an oversized, digitized sewing pattern selected by the user, the mechanized frame having a motorized sewing machine carriage with a sewing machine mounted thereon, the motorized sewing machine carriage being controlled by an actuator and providing for two dimensional positioning of the sewing machine on the mechanized frame, the sewing machine having an available throat length, the sewing pattern having a pattern length which is greater than the available throat length, the sewing pattern having one or more pattern lines, the mechanized frame having a fabric retention mechanism, the method comprising:

providing the digitized sewing pattern to the actuator;

segmenting the sewing pattern into a plurality of digitized pattern segments, each pattern segment having a segment length which is equal to or less than the available throat length, each pattern segment having a segment first border and a segment second border;

receiving or selecting an order for the sequential sewing of the respective pattern segments;

positioning the fabric on the fabric retention mechanism as required to position the fabric for a pattern segment to be sewed;

sewing each of the pattern segments in the order selected, identifying a cut point for each point where a pattern line of a sewed pattern segment crosses the segment first border of the sewed pattern segment which is to be adjacent to a segment second border of a subsequently sewed adjacent pattern segment, or crosses the segment second border of the sewed pattern segment which is to be adjacent to a segment first border of a subsequently sewed adjacent pattern segment; and adjusting the pattern lines of each subsequently sewed pattern segment to fit the pattern lines to the cut points of the adjacent previously sewed pattern segment.

6. The method of claim 5 wherein the mechanized frame comprises a mechanized quilting frame.

7. The method of claim 5 wherein the fabric retention mechanism comprises one or more feed rails and one or more take-up rails.

8. An apparatus for using a mechanized frame for the automated sewing on fabric of an oversized, digitized sewing pattern selected by the user, the mechanized frame having a motorized sewing machine carriage with a sewing machine mounted thereon, the sewing machine having an available throat length, the sewing pattern having a pattern length which is greater than the available throat length, the sewing pattern having one or more pattern lines, the mechanized frame having a fabric retention mechanism, the apparatus comprising:

an actuator having a carriage control program for controlling the motorized sewing machine carriage and providing for two dimensional positioning of the sewing machine on the mechanized frame;

an actuator access to a digitized sewing pattern;

an actuator pattern program for segmenting the sewing pattern into a plurality of digitized pattern segments, each pattern segment having a segment length which is equal to or less than the available throat length, each pattern segment having a segment first border and a segment second border;

receiving or selecting an order for the sequential sewing of the respective pattern segments;

positioning the fabric on the fabric retention mechanism as required to position the fabric for a pattern segment to be sewed;

sewing each of the pattern segments in the order selected, identifying a cut point for each point where a pattern line of a sewed pattern segment crosses the segment first border of the sewed pattern segment which is to be adjacent to a segment second border of a subsequently sewed adjacent pattern segment, or crosses the segment second border of the sewed pattern segment which is to be adjacent to a segment first border of a subsequently sewed adjacent pattern segment; and adjusting the pattern lines of each subsequently sewed pattern segment to fit the pattern lines to the cut points of the adjacent previously sewed pattern segment.

9. The apparatus of claim 8 wherein the mechanized frame comprises a mechanized quilting frame.

10. The apparatus of claim 8 wherein the fabric retention mechanism comprises one or more feed rails and one or more take-up rails.

* * * * *